United States Patent [19]

Holbek

[11] 4,222,149

[45] Sep. 16, 1980

[54] DOOR HINGE ARRANGEMENT PERMITTING OPENING OF THE DOOR ALTERNATIVELY AT EITHER SIDE

[76] Inventor: Gert A. E. Holbek, Søvej 1, DK-2840 Holte, Fed. Rep. of Germany

[21] Appl. No.: 924,226

[22] Filed: Jul. 13, 1978

[51] Int. Cl.[2] ..... E05D 15/50

[52] U.S. Cl. ..... 16/147; 16/171; 49/193; 49/382

[58] Field of Search ..... 16/147, 171, 172, 173, 16/174, 175, 176, 177, 178, 179, DIG. 23; 49/382, 192, 193

[56] References Cited

U.S. PATENT DOCUMENTS

| | | | |
|---|---|---|---|
| 3,403,473 | 10/1968 | Navarro | 16/147 X |
| 3,486,272 | 12/1969 | Eigenmann et al. | 16/147 X |
| 3,685,093 | 8/1972 | Sanders et al. | 16/147 |
| 3,889,419 | 6/1975 | Maleck | 16/147 X |

*Primary Examiner*—C. J. Husar
*Assistant Examiner*—Moshe I. Cohen
*Attorney, Agent, or Firm*—Watson, Cole, Grindle & Watson

[57] ABSTRACT

A door hinge arrangement permitting opening of the door alternatively at either side, comprising a mounting for attachment to the door at the upper edge thereof, and a mounting for attachment to the door at the lower end thereof, each mounting carrying two hinge sets for engagement with hinge pivots fixed to the frame of the door, a trapping member associated with each mounting, the trapping member being slidable longitudinally of the mounting in either direction from a middle position and having a guide so constructed that in the initial phase of the opening of the door at one side each trapping member is so displaced as to trap the corresponding hinge pivot in the hinge seat at the other side of the door, the hinge seats being located at the outer ends of the mountings, the trapping members having a length not exceeding the distance between the outer ends of the hinge seats, a guide being arranged for displacing the trapping members in a direction away from the side, at which the door is being opened.

4 Claims, 6 Drawing Figures

DOOR HINGE ARRANGEMENT PERMITTING OPENING OF THE DOOR ALTERNATIVELY AT EITHER SIDE

BACKGROUND OF THE INVENTION

The invention relates to a door hinge arrangement permitting opening of the door alternatively at either side, comprising a mounting for attachment to the door at the upper edge thereof, and a mounting for attachment to the door at the lower end thereof, each mounting carrying two hinge seats for engagement with hinge pivots fixed to the frame of the door, a trapping member associated with each mounting, said trapping member being slidable longitudinally of the mounting in either direction from a middle position and having guiding means so constructed that in the initial phase of the opening of the door at one side each trapping member is so displaced as to trap the corresponding hinge pivot in the hinge seat at the other side of the door.

In a door hinge arrangement of this kind known from Danish patent specification No. 110,007, the hinge seats are constituted by slots of the trapping member at some distance from its ends.

SUMMARY OF THE INVENTION

In contradistinction to this known arrangement, according to the invention, the hinge seats are located at the outer ends of the mountings, the trapping members have a length not exceeding the distance between the outer ends of the hinge seats, and the guiding means are arranged for displacing the trapping members in a direction away from the side, at which the door is being opened. Hereby the advantage is obtained that the hinge arrangement may be used for doors requiring mounting of the hinge pivots close to the vertical frame pieces of the door opening, for which the door in question serves. This is e.g. the case with rabbeted doors, or doors which are to be placed in close proximity in order to achieve an aesthetic appearance, e.g. kitchen cupboard doors. The outlying position of the hinge pivots permitted by the door hinge arrangement according to the invention moreover makes this suitable for use as a strap hinge construction.

In an advantageous embodiment of the invention, the guiding means comprise inclined end faces of the trapping members arranged for engagement with the hinge pivots. This embodiment is very simple because only one movable part, viz. the trapping member, is needed for each mounting so that the door hinge arrangement will be cheap to manufacture.

In another advantageous embodiment of the invention, the hinge seats are resiliently supported at the outer ends of the mountings at a bias against the trapping members, each hinge seat being provided with a projection for engagement with the corresponding end face of the corresponding trapping member in the position thereof where the other end of the corresponding trapping member traps the hinge pivot there present, the trapping member being biased by springs towards its middle position. This embodiment has the advantage that the trapping members are automatically and positively held in their displaced positions so that any danger of unintentional displacement from this position is excluded.

In a still further embodiment of the invention, the hinge seats are connected with each other by means of a connecting rod which is longitudinally non-displaceably mounted in the corresponding mounting, the trapping member being slidably connected with the connecting rod, the guiding means of the trap member being constituted by slots of the trapping member engageable with inclined blocks mounted in the corresponding mounting. An advantage of this embodiment is that the trapping member of each mounting is positively guided both when moved to its displaced position and when moved back again. This is due to the co-operation of the trapping member and the side faces of the inclined blocks so that no springs are required for causing the return movement. Also in this embodiment the trapping member is automatically locked in its displaced position.

DESCRIPTION OF THE PREFERRED EMBODIMENT

Figure 1:
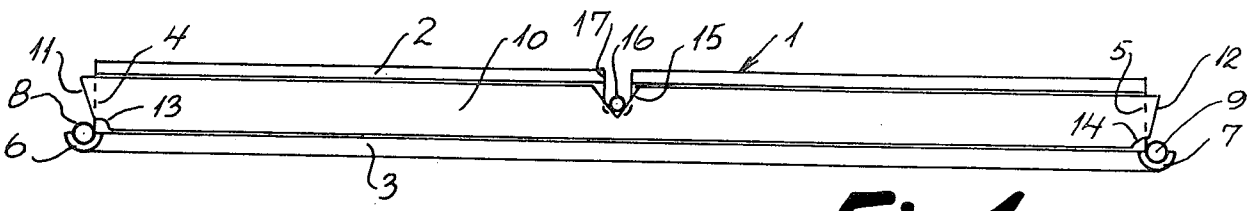
FIG. 1 shows the lower half of a door hinge arrangement according to a first embodiment of the invention, the door being in its closed position.
Figure 2:
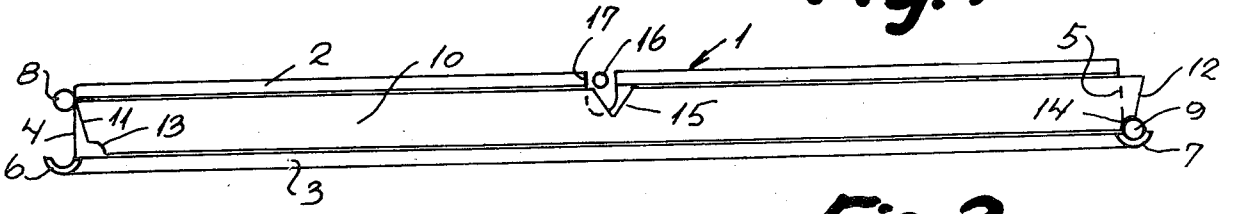
FIG. 2 shows the door hinge arrangement of FIG. 1 in the initial phase of opening the door.

To a door belong two hinging structures, viz. one for attachment to the door at the lower edge thereof and another for attachment to the door at the upper edge thereof. Since these structures are identical, only the lower structure is shown in the drawing. In FIGS. 1 and 2, 1 is a mounting of U-shaped cross section, the side flanges of which are denoted 2 and 3. For attachment to the lower edge of the door one or both of these flanges may have lugs with screw holes. The side flange 3 is extended beyond the terminal edges 4 and 5 of the mounting 1 and the extensions from hinge seats 6 and 7 for engagement with hinge pivots 8 and 9 respectively. These hinge pivots can be attached to the lower frame member of the door frame or they may be strap hinge pivots. A trapping member 10 is slidably mounted in the mounting 1 and is constructed with inclined end faces 11 and 12. At the point of transition between each of the end faces and the edge of the trapping member 10 facing the flange 3 a cut 13 and 14 respectively is provided having substantially the shape of one quarter of a circle. Approximately at its middle the trapping member 10 has a V-shaped cut 15 for engagement with a pin 16 which is fixed to the door frame. To permit the pin 16 to pass to and from engagement with the V-shaped cut a U-shaped cut 17 is provided in the mounting 1.

In the closed position of the door represented in FIG. 1, the innermost ends of the two inclined faces 11 and 12 are located flush with the inner sides of the two hinge pivots 8 and 9. In the initial phase of the opening of the door at one side thereof, e.g. that to the left in FIGS. 1 and 2, the trapping member 10 will therefore be displaced to the position shown in FIG. 2, because during this initial opening the hinge pivot 8 will push the trapping member 10 to the right as a consequence of the co-operation with the inclined face 11. Thereby the cut 14 at the opposite end of the trapping member 10 is caused to engage the hinge pivot 9 there present to trap the latter in the hinge seat 7 so that the door is restrained from opening at that side. In the initial opening phase the V-shaped cut 15 will at the same time move away from the pin 16. Since the structure is symmetrical about its transverse axis it will be understood that opening of the door at its right hand side edge will take place in the same manner as described, only the hinge pivot 8 will in that case be trapped in its hinge 6 by means of the left hand end of the trapping member 10.

When the door is closed, the pin 16 will during the last phase of the closing movement, at the time when the inclined face 11 starts moving past the hinge pivot 8, engage with the left hand edge of the V-shaped cut 15, whereby the trapping member 10 is displaced back to the position shown in FIG. 1. The door hinge arrangement is now in readiness for opening the door alternatively at the right hand and at the left hand side.

Figure 3:
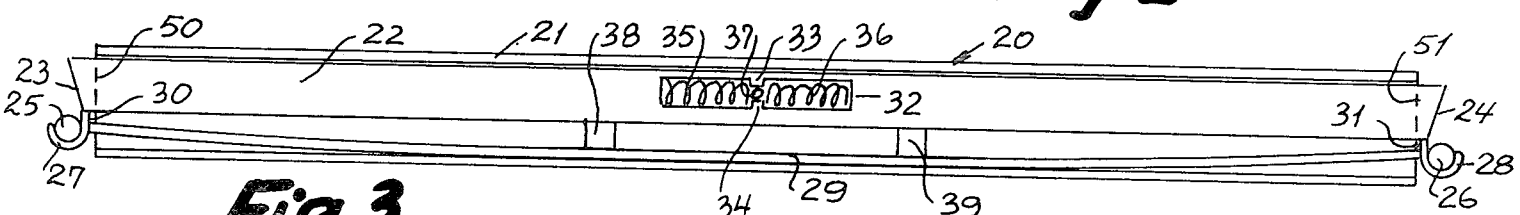
FIG. 3 shows the lower half of a door hinge arrangement according to a second embodiment of the invention, the door being in its closed position.
Figure 4:
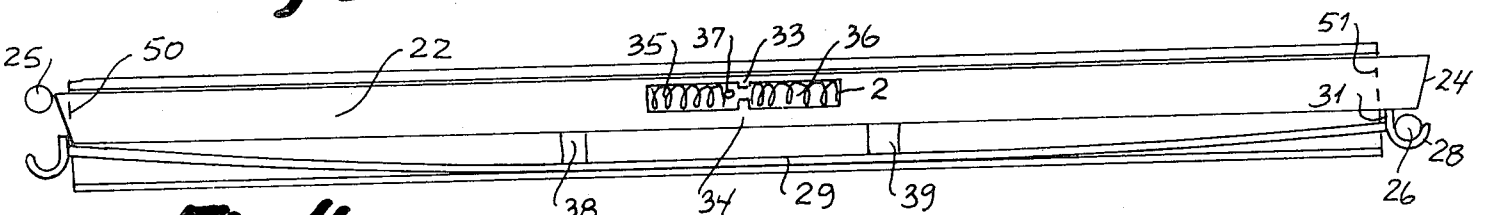
FIG. 4 shows the door hinge arrangement of FIG. 3 in the initial phase of opening the door.

In FIGS. 3 and 4, 20 is a mounting of U-shaped cross section, the flanges of which are denoted 21. For attachment of the mounting to the lower edge of a.door one or both of the flanges 21, 21*a* may be provided with lugs. A trapping member 22 is slidably mounted in the mounting 20 and is constructed with inclined end faces 23 and 24 serving as cam faces in co-operation with hinge pivots 25 and 26. The mounting is provided with two hinge seats 27 and 28, which are connected with each other through a resilient rod 29.

The hinge seats 27 and 28 have a width in a direction perpendicular to the plane of the drawings so that their ends remote from the observer extend beyond the ends 50 and 51 of the bottom flange or mounting 20 so that the structure comprising the hinge seats 27, 28 and the connecting rod 29 is substantially restrained from displacement in the longitudinal direction of the mounting 20. Each hinge seat 27 and 28 is provided at the side facing the connecting rod 29 with a small extension 30, 31 in the direction of the trapping member 22, forming an abutment for the adjacent end of the trapping member 22.

At its middle the trapping member 20 is provided with a longitudinal slot 32, which at its middle is narrowed by means of two projections 33 and 34. Two restoring springs 35 and 36 are mounted in the slot 32 for co-operation with a pin 37 which is fixed to the bottom flange 22 of the mounting 20 and which in the middle position of the trapping member 22 is located between the projections 33 and 34. For guiding the trapping member 22 along the flange 21 a pair of guiding blocks 38 and 39 are arranged between the trapping member 22 and the connecting rod 29. The latter is as previously mentioned resilient and is biased to urge the extensions 30, 31 of the hinge seats against the adjacent ends of the trapping member 22.

The operation of the embodiment shown in FIGS. 3 and 4 is as follows:

In the initial phase of opening the door at its left hand side, the hinge pivot 25 will co-operate with the inclined cam face 23 to displace the trapping member 22 to the right in FIG. 3 against the action of the spring 35. Thereby the opposite end of the trapping member 22 is moved to the position shown in FIG. 4 to trap the hinge pivot 26 in the hinge seat 28. Simultaneously with the displacement the extension 30 of the hinge seat 27 will as a consequence of the bias of the rod 29 snap up in front of the cam face 23, whereby the trapping member 22 is locked in the position shown in FIG. 4. This locking is broken only when the door is again closed, when, in the last phase of the closing movement, the hinge seat 27 is engaged with the hinge pivot 25 and thereby pulls the extension away from the cam face 23, whereupon the spring 35 urges the trapping member 22 to the left back to the middle position shown in FIG. 3, where the pin 37 is held between the projections 33 and 34 by means of the two springs 35 and 36. The door hinge arrangement is now in readiness for renewed opening of the door at either side.

Figure 5:
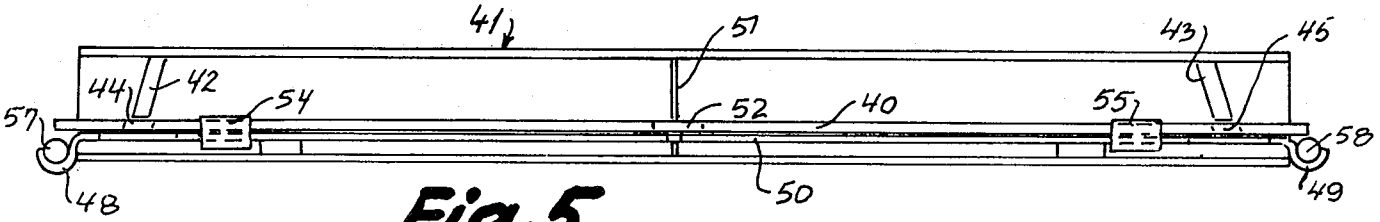
FIG. 5 shows the lower half of a door hinge arrangement according to a third embodiment of the invention, the door being in its closed position.
Figure 6:
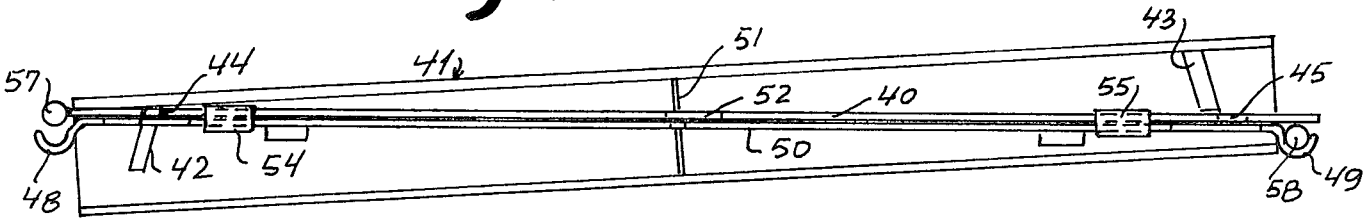
FIG. 6 shows the door hinge arrangement of FIG. 5 in the initial phase of opening the door.

In the embodiment of FIGS. 5 and 6 both the displacement of the trapping member 40 to its trapping positions and its restoration to the middle position shown in FIG. 5 is effected by cam action, for which purpose two inclined blocks 42 and 43 are mounted in the mounting 41 for co-operation with slots 44 and 45 of the trapping member 40 respectively. In the embodiment of FIGS. 5 and 6, the hinge seats 48 and 49 are carried by the ends of a connecting rod 50 which is mounted in the mounting 41 and is restrained from displacement longitudinally thereof by means of a transverse pin 51. In the trapping member 40 there is provided a longitudinal slot 52 so that the trapping member may slide longitudinally relative to the pin 51.

The trapping member 40 and the connecting rod 50 are connected with each other by means of two clamps 54 and 55, which permit the trapping member 40 to move longitudinally relative to the connecting rod 50, but prevent these from being separated.

The operation of the embodiment of FIGS. 5 and 6 is as follows:

In the initial phase of the opening of the door at the left side, the left end of the trapping member 40 engages the adjacent hinge pivot 57. Thereby the slot 44 is caused to travel along the inclined guiding block 42, whereby the trapping member is moved to the right in FIG. 5 to cause its opposite end to trap the hinge pivot 58 there present in the corresponding hinge seat 49. At the same time the left end of the trapping member 40 is pulled away from the hinge pivot 57 so that the door can be opened, see FIG. 6. At the same time, the trapping member 40 is locked in its displaced position by its engagement between the slot 44 and the block 42. During the displacement of the trapping member 40 as described its right hand end moves past the free end of the block 43.

When the door is again closed, the hinge seat 48 engages the hinge pivot 57, whereby, owing to the provision of the clamp 54, the connecting rod 50 moves the slot 44 of the trapping member 40 along the block 42, thereby moving the trapping member 40 to the left in FIGS. 5 and 6 to the middle position shown in FIG. 5. The door hinge arrangement is now in readiness for renewed opening of the door at either side.

It will be seen that in all the embodiments the hinge seats constitute the extreme ends of the door hinge structures, which permits a correspondingly outlying arrangement of the hinge pivots. It will be realized that in the present specification the term "door" should be understood in its widest sense so as to comprise e.g. windows, hatches, shutters and gate.

I claim:

1. A door hinge arrangement permitting opening of the door alternatively at either side, comprising a mounting for attachment to the door at the upper edge thereof, and a mounting for attachment to the door at the tower end thereof, each mounting carrying two hinge seats for engagement with hinge pivots fixed to the frame of the door, a trapping member associated with each mounting, said trapping member being slidable longitudinally of the mounting in either direction from a middle position and having cam means so arranged and constructed that in the initial phase of the opening of the door at one side the cam means longitudinally slide each trapping member so as to trap the corresponding hinge pivot in the hinge seat at the other side of the door, the hinge seats (6, 7; 27, 28; 48, 49) being located at the outer ends of the mountings (1; 20; 41), and the trapping members (10; 22; 40) having a length not exceeding the distance between the outer ends of the hinge seats and being such as to be displaced by the cam means in the direction away from the side at which the door is being opened.

2. A door hinge arrangement as in claim 1, in which the cam means comprise inclined end faces (11, 12; 23,24) of the trapping members (10; 22) arranged for engagement with the hinge pivots (10; 22).

3. A door hinge arrangement as in claim 1, in which the hinge seats (27, 28) are resiliently supported at the outer ends of the mountings (20) at a bias against the trapping members (22), each hinge seat being provided with a projection, (30, 31) for engagement with the corresponding end face (23, 24) of the corresponding trapping member (22) in the position thereof where the outer end of the corresponding trapping member (22) traps the hinge pivot (25, 26) there present, the trapping member being biased by springs (35, 36) towards its middle position.

4. A door hinge arrangement as in claim 1, in which the hinge seats (48, 49) are connected with each other by means of a connecting rod (50) which is longitudinally non-displaceably mounted in the corresponding mounting (41), the trapping member (40) being slidably connected (at 54, 55) with the connecting rod (50), the cam means of the trapping member (40) being constituted by slots (44, 45) of the trapping member engageable with inclined blocks (42, 43) mounted in the corresponding mounting (41).

* * * * *

UNITED STATES PATENT OFFICE

CERTIFICATE OF CORRECTION

PATENT NO. : 4,222,149

DATED : September 16, 1980

INVENTOR(S) : Gert A. E. Holbek

It is certified that error appears in the above-identified patent and that said Letters Patent are hereby corrected as shown below:

In the title page correct the country address of the inventor by deleting "Fed. Rep. of Germany" and substituting --Denmark--.

Signed and Sealed this

*Third* Day of *March 1981*

[SEAL]

*Attest:*

RENE D. TEGTMEYER

*Attesting Officer*

*Acting Commissioner of Patents and Trademarks*